US005381750A

United States Patent [19]

Pollack

[11] Patent Number: 5,381,750

[45] Date of Patent: Jan. 17, 1995

[54] VESSEL TURRET MOORING SYSTEM

[75] Inventor: Jack Pollack, Camarillo, Calif.

[73] Assignee: Imodco, Inc., Calabasas Hill, Calif.

[21] Appl. No.: 162,338

[22] Filed: Dec. 2, 1993

[51] Int. Cl.[6] ..... B63B 21/52

[52] U.S. Cl. ..... 114/230; 441/5

[58] Field of Search ..... 114/230; 441/3, 4, 5

[56] References Cited

U.S. PATENT DOCUMENTS

| | | | |
|---|---|---|---|
| 3,279,404 | 10/1966 | Richardson . | |
| 3,620,181 | 11/1971 | Naczowski . | |
| 4,305,341 | 12/1981 | Stafford . | |
| 4,519,728 | 5/1985 | Oshima . | |
| 4,604,961 | 8/1986 | Ortloff et al. | 441/5 |
| 4,606,727 | 8/1986 | Koenig . | |
| 4,637,335 | 1/1987 | Pollack . | |
| 4,650,431 | 3/1987 | Kentosh . | |
| 4,701,143 | 10/1987 | Key et al. . | |
| 4,765,378 | 8/1988 | Engelskirchen . | |
| 4,955,310 | 9/1990 | Pollack . | |
| 5,065,689 | 11/1991 | Krogstad . | |
| 5,178,087 | 1/1993 | O'nion et al. . | |

FOREIGN PATENT DOCUMENTS

| | | | |
|---|---|---|---|
| 162982 | 2/1980 | Netherlands | 441/5 |

*Primary Examiner*—Stephen P. Avila

*Attorney, Agent, or Firm*—Arthur Freilich; Robert D. Hornbaker; Leon D. Rosen

[57] ABSTRACT

A vessel with a rotatable turret thereon is moored in a manner that minimizes turret tilt while avoiding the need to maintain precisely concentric upper and lower turret bearings. A mooring structure (152, FIG. 7) is formed by a group of mooring lines (162, 164) such as chains, with the upper ends of the lines coupled to the vessel through a connecting apparatus (154) that comprises a group of arms (166) each connected to a corresponding one of the lines. Each arm is pivotally mounted (at 170) on the turret to hang therefrom, so the arm transmits primarily vertical forces to the turret and the turret bearing (185) has to support primarily vertical forces. Each arm carries a bearing pad (174) that presses horizontally against a vessel lower bearing ring (182) mounted directly on the vessel hull independently of the turret. Substantially the entire horizontal components H of mooring force are transmitted from the arm pads to the lower vessel bearing ring, so the horizontal force components are not transmitted through the turret. As a result, the turret does not tend to tilt, and the vessel lower bearing ring which transmits horizontal mooring force components does not have to be mounted precisely concentric with the upper bearing.

12 Claims, 5 Drawing Sheets

FIG. 1
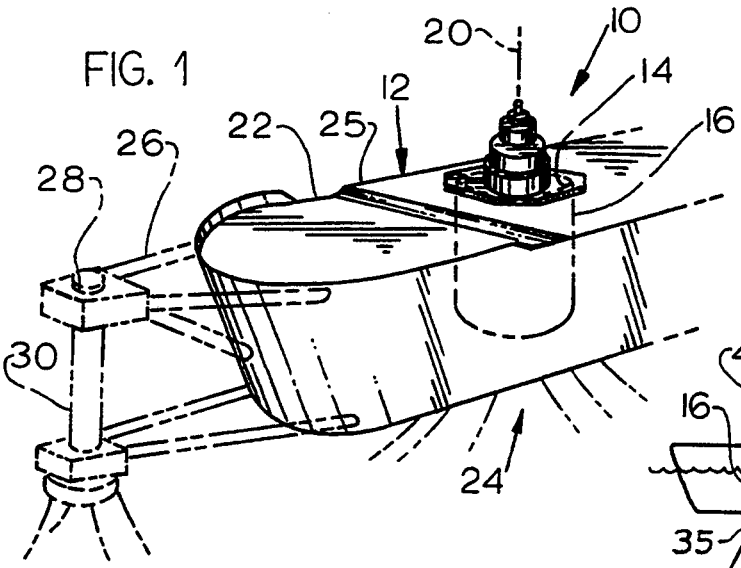
FIG. 2
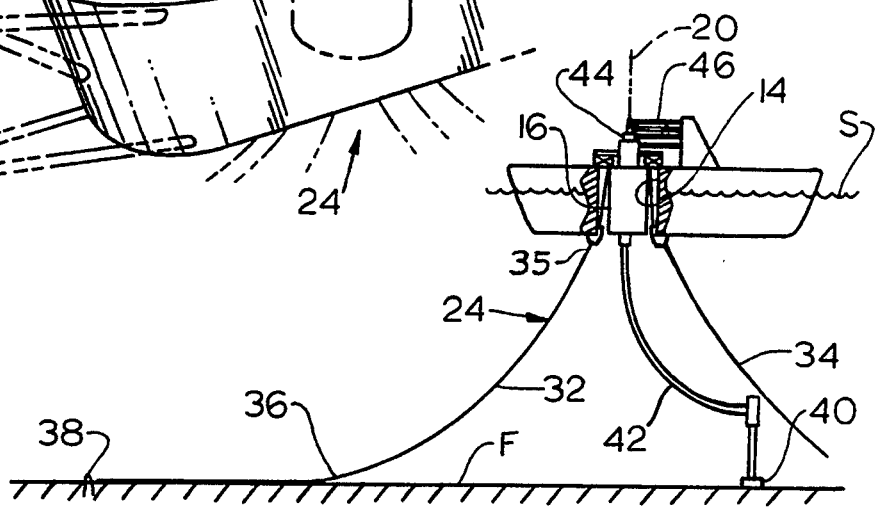
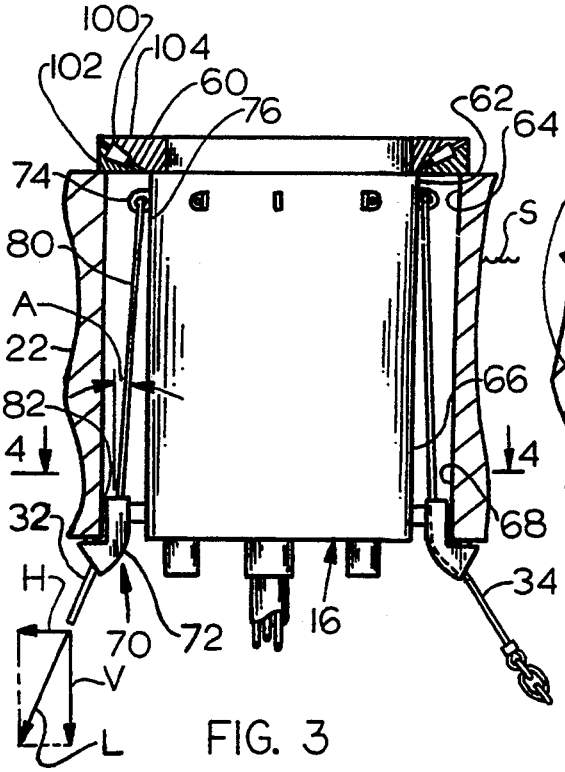
FIG. 3
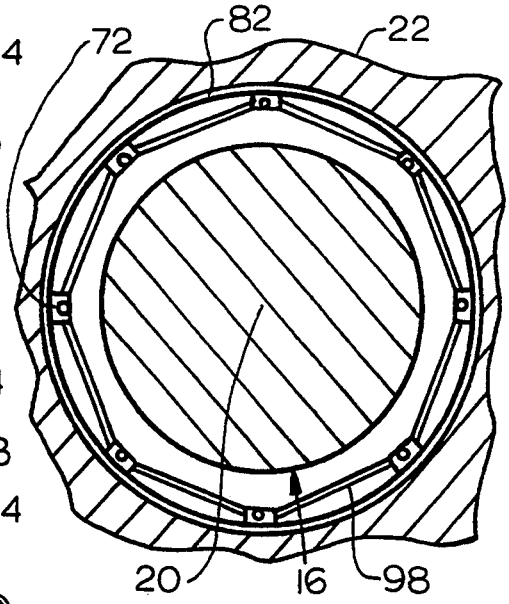
FIG. 4

FIG. 5
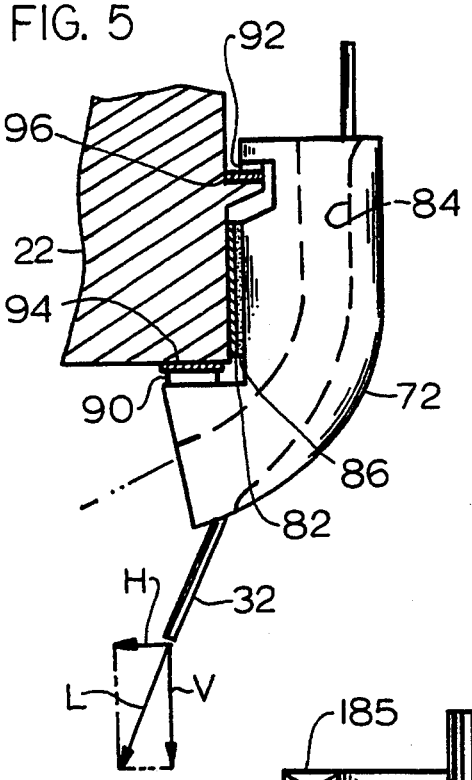
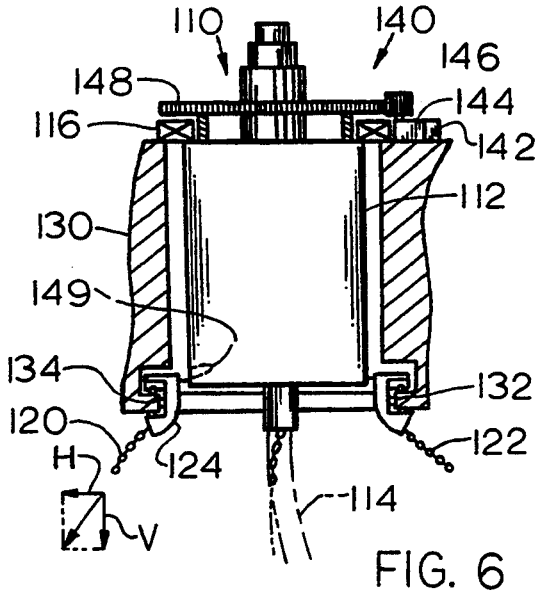
FIG. 6
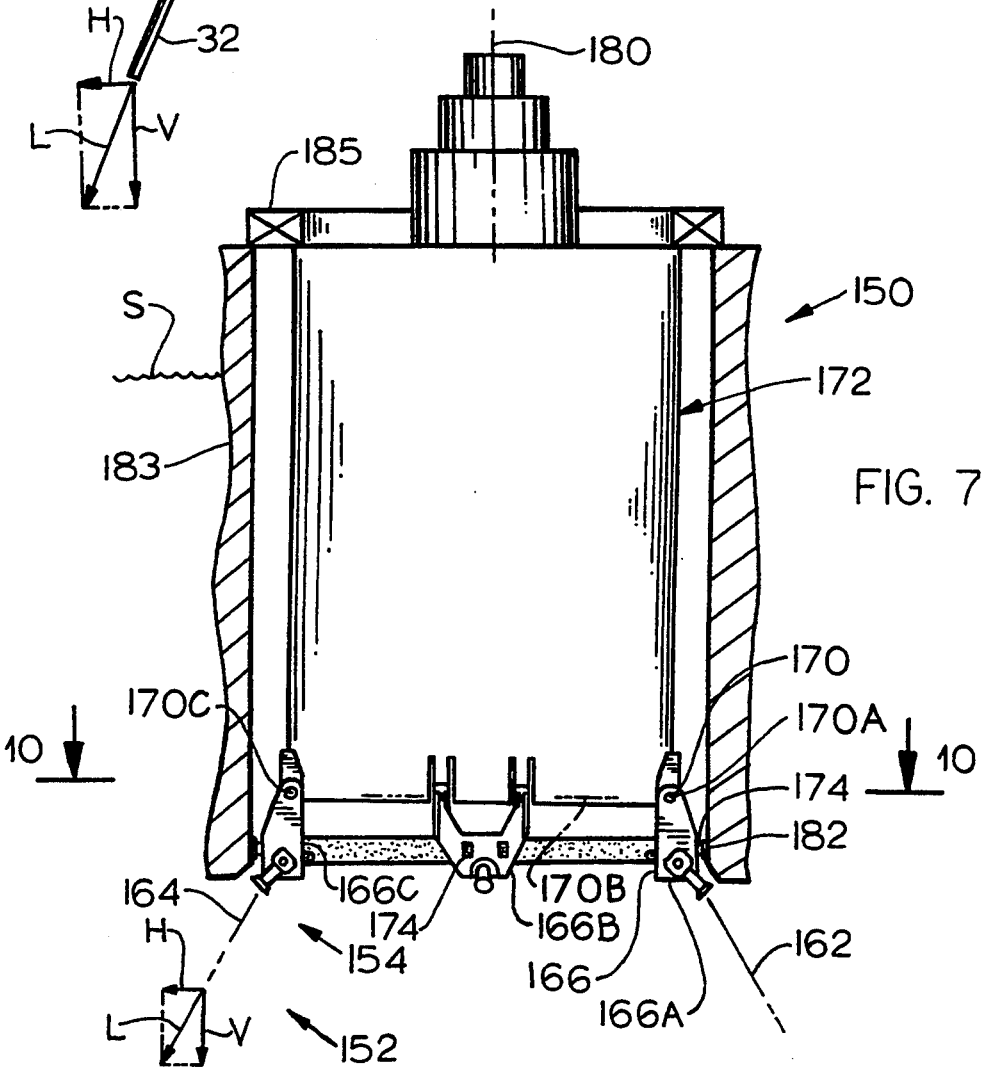
FIG. 7

VESSEL TURRET MOORING SYSTEM

BACKGROUND OF THE INVENTION

One type of vessel has a turret rotatably mounted on the vessel hull, so the turret does not rotate with the hull. A mooring structure such as several catenary lines extending up from the sea floor, connect to the turret, so mooring forces that limit vessel drift are transmitted through the turret to the vessel. A conduit with several hoses may extend from the sea floor up to the nonrotating turret, and through a fluid swivel structure at the top of the turret to pipes on the vessel.

A typical prior art turret is supported on the vessel by upper and lower bearings to withstand both the constant vertical load on the turret due to the weight of the mooring lines, and to withstand large net horizontal mooring forces applied during storms. One problem arising with such a system is that the upper and lower bearings have to be mounted and maintained precisely concentric on the vessel hull, which is very difficult to achieve. Even when concentricity is achieved, it can be lost by deformations of the ship hull. Still another problem is that the lower bearing is difficult to maintain and repair in the field. While the upper bearing lies above the sea surface, the lower bearing lies a considerable distance such as twenty meters below the sea surface, where it is difficult to replace large parts. It is possible to use a single upper bearing, but it is difficult to transfer large horizontal mooring load components to such a single upper bearing, without large internal loading of the turret and the use of a massive upper bearing. A mooring system for a turreted vessel which simplified bearing installation, maintenance and repair, would be of considerable value.

SUMMARY OF THE INVENTION

In accordance with one embodiment of the present invention, a turret vessel mooring system is provided which avoids the need for accurate alignment of upper and lower turret bearings, which facilitates repair of the underwater lower bearing, and which minimizes internal loading of the turret. The system includes a vessel lower bearing device lying at the lower portion of the turret cavity and mounted on the vessel hull independently of the turret. A connecting apparatus that is coupled to the upper portions of mooring lines or other mooring structure, transmits the horizontal components of the mooring loads directly to the independently-mounted vessel lower bearing device. Thus, large horizontal mooring load components are not applied to the turret.

One connecting apparatus comprises a group of arms spaced about the lower end of the turret, with each arm having an upper end pivotally mounted on the turret and a lower end connected to the upper end of a mooring line. Each arm carries a bearing pad that presses horizontally against the vessel lower bearing device to transmit substantially all horizontal forces directly to the vessel hull through the lower bearing device. The vertical components of mooring loads applied to the arms are transmitted through the pivotally mounted upper arm ends to the turret. As a result, the turret bearing connected to the upper end of the turret, supports substantially all of the vertical mooring load components.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial isometric view of a mooring system constructed in accordance with one embodiment of the present invention, and showing in phantom lines another vessel and turret construction.

FIG. 2 is a partially sectional side view of the mooring system of FIG. 1.

FIG. 3 is a partially sectional side view of the turret and surrounding structure of the system of FIG. 2.

FIG. 4 is a view taken on the line 4—4 of FIG. 3.

FIG. 5 is a partially sectional side view of one of the line guides of the system of FIG. 3.

FIG. 6 is a partial sectional side view of another mooring system.

FIG. 7 is a partial sectional side view of another mooring system.

DESCRIPTION OF THE PREFERRED EMBODIMENTS

Figure 8:
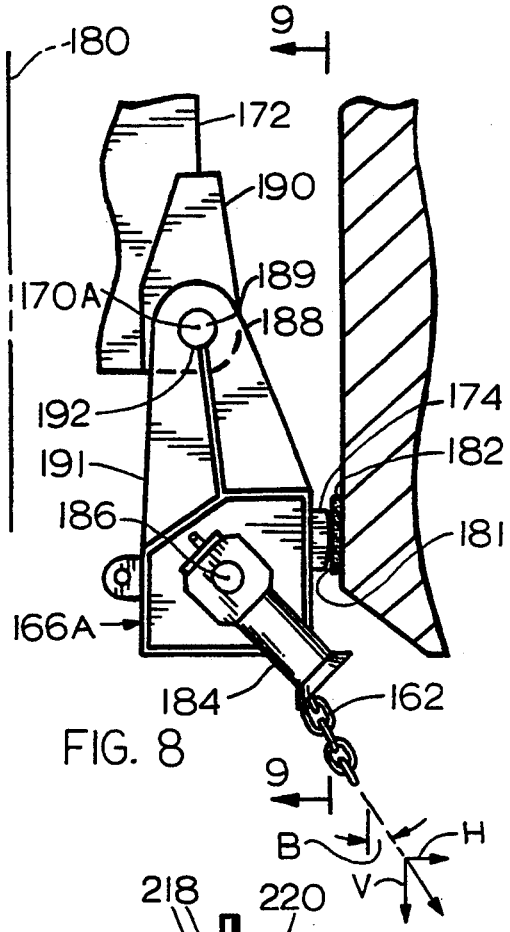
FIG. 8 is a view of a portion of the mooring system of FIG. 7.

FIG. 1 illustrates a mooring system 10 which includes a vessel 12 that forms a primarily vertically extending turret cavity 14. A turret 16 lies at least adjacent to the cavity as by lying in it, and the turret is rotatable about a substantially vertical turret axis 20 with respect to the vessel hull 22. A mooring structure 24 such as a group of catenary lines (which may be in the form of chains and/or cables) moors the vessel. The lines extend downwardly and in different horizontal directions from the vessel. In the particular system shown in solid lines in FIG. 1, the turret cavity 14 lies within the main part 25 of the vessel hull. In should be noted that in another type of system shown in phantom lines in FIG. 1, the hull includes a structure 26 extending beyond the bow of the original vessel, to provide a cavity 28 which supports a turret 30 lying beyond the main part of the hull. The present invention is applicable to both types of systems.

FIG. 2 shows the system in a quiescent configuration or position, when there is no substantial wind, waves, or currents, so the turret axis 20 is vertical and the mooring lines 32, 34 apply equal mooring loads. The mooring lines 32, 34 of the mooring structure 24, each have lower portions 36 extending down to the seafloor F, the lines extending along the seafloor to anchor locations 38. The particular system is used to produce oil from an undersea well 40 which is connected by a flexible pipe or conduit 42 to the turret, so fluids can flow through a multiple conduit fluid swivel 44 to pipes 46 on the vessel. The conduit 42 may contain several hoses, or several conduits can be used.

As shown in FIG. 3, the weight of the turret is supported by a turret bearing 60. The turret bearing is coupled to an upper portion 62 of the turret which lies at an upper portion 64 of the turret cavity, and with both lying above the sea surface S. Lower portions 66, 68 respectively of the turret and cavity lie below the sea surface. The upper ends of the mooring lines such as 32, 34 are coupled through a connecting apparatus 70 to the vessel. The connecting apparatus includes a group of fairleads 72 which serves as a connection portion and brackets 74. Each mooring line such as 32 is slidably guided through a corresponding fairlead 72, with the upper end 76 of the mooring line attached to a corresponding bracket 74 which is fixed to the upper portion 62 of the turret.

The fairleads 72 and brackets 74 are arranged so the upper portion 80 of the mooring line extends primarily vertically between them. As a result, the mooring line upper portion 80 can apply primarily only a vertical force component to the turret. The angle A of the line upper portion from the vertical is less than 15° and preferably less than 10°, so less than 25% (the sine of 15°=25%) and preferably less than 17 percent (the sine of 10°=17%) of the horizontal component H of the mooring load L applied through each mooring line 32 is applied to the turret. Thus, preferably more than 83 percent of the horizontal load components are transmitted to the vessel lower bearing device. Almost the entire (over 80 percent and preferably over 90 percent) vertical component V of the mooring load L is applied to the turret. Almost all of the horizontal component H of the mooring load applied by a mooring line is applied by the fairlead 72 to a vessel lower bearing device 82 which is fixed to the hull 22 of the vessel, independently of the turret. Of course, the total mooring loading of the vessel is the vector sum of the loads L applied to the mooring lines, with the horizontal components canceling in fair weather.

FIG. 5 shows some details of the fairlead or line guide 72. The mooring line 32 is guided in slidable movement through a guide passage 84. The horizontal component of tension in the mooring line presses a bearing pad 86 of the line guide 72 firmly against the vessel lower bearing device 82. The mooring line slides only short distances on the guide, so it is possible to provide a pivot connection of the mooring line to the line guide to provide a substantial slidable connection that minimizes wear. The line guide bearing pad 86 bears against the vessel lower bearing device for moderately low frictional sliding contact thereagainst. It is noted that the line guide 72 has secondary bearings 90, 92 that bear against corresponding secondary bearing devices 94, 96 on the vessel hull, to prevent loss of the line guide. However, almost all of the force applied by the mooring line 32 to the line guide 72 is the horizontal component H of the mooring line tension or load L, and is applied to the bearing device 82.

The number of mooring lines can vary, with a theoretical minimum of three, and with a larger number such as eight often used. FIG. 4 shows spacers 98 which keep eight line guides 72 uniformly spaced apart, so they all turn in unison around the vessel lower bearing device 82.

One important advantage of the present system over the prior art, is that the vessel lower bearing device 82 does not have to be mounted and maintained precisely concentric with the turret bearing 60. Because of manufacturing tolerances and warping that occurs during construction and over the life of a vessel, it previously has been difficult to mount and maintain upper and lower turret bearings precisely concentric. Although applicant prefers to locate the vessel lower bearing device 82 substantially concentric with the upper turret bearing 60 and therefore with the turret axis 20, such locating need not be accomplished with precision. The bearing device is shiftable horizontally independently of the turret, and a small amount of shifting (e.g. a few centimeters where the turret has a diameter of 10 meters) does not have much effect. It can be seen that the fairleads or connection portions 72, can shift horizontally substantially independently of the lower portion 66 of the turret.

Another advantage of the present system is that only small portions of the horizontal load components are applied to the turret 16. Also, these small horizontal portions are applied to the upper portion 62 of the turret, rather than to the lower turret portion where any horizontal force could result in a large moment arm with respect to the upper turret bearing 60. As a result, there is little horizontal loading of the turret even in a severe storm when there is a large net horizontal loading that must be withstood by the vessel. It is noted that the vertical force components applied to the turret represent primarily the weight of the lines and are relatively constant between good weather conditions and severe weather.

The turret bearing 60 includes rolling elements such as roller bearings 100 or bogies that rotate on raceways, with one raceway 102 mounted on the hull and the other 104 mounted on the turret. Accordingly, there is relatively little wear despite constant loading. Large horizontal load components H are encountered only in severe weather, which occurs only occasionally. As a result, there is relatively small wear at the vessel lower bearing device 82 and at the bearing pads 86 on the line guides. This is desirable because this sliding bearing arrangement 82, 86 undergoes considerable wear when high loads are applied, even though they are of low sliding friction bearing material. The bearing pads 86 are of relatively small weight, and can be replaced in the field.

The effective coefficient of friction for rolling members such as at the upper turret bearing 60 is relatively low, such as less than one percent, so the turret will readily turn even under light loading. The coefficient of friction at the vessel lower bearing device 82 and bearing pads 86 is higher, such as perhaps ten percent. However, the horizontal load component H is usually small and does not significantly retard rotation of the turret which is usually primarily under the influence of the large vertical load component V. In severe weather, the horizontal load component H is large, and any rotational misalignment of the turret with the mooring lines results in a large turret turning force.

FIG. 6 is a partial sectional view of a mooring system 110 constructed in accordance with another embodiment of the invention. In this system, the only vertical load on the turret 112 is due to the weight of the turret and the weight of the conduit 114 and equipment attached to the conduit. The weight of the turret and the weight it carries is supported by an upper turret bearing 116. The upper ends of mooring lines such as 120, 122 are fixed to fairleads 124 which are rotatably supported on the vessel hull 130 independently of the turret. In this case, the vessel carries a horizontal vessel bearing device 132 in the form of a ring-shaped slider bearing to take the horizontal load component H. The vessel also carries half of a vertical bearing 134 which can include rolling elements, to take the vertical load component V. Due to the fact that the mooring lines such as 120 are not connected to the turret 112, a separate turret rotating mechanism 140 is provided to turn the turret with respect to the vessel hull, so the turret remains substantially unturned as the vessel turns, to avoid twisting of the conduit 114. The mechanism can include a sensor 142 that senses turning of the vessel and which operates a motor 144 that turns gears 146, 148 to turn the turret. As an alternative, a rod 149 can be provided that extends from a fairlead to a slot in the turret, to cause the turret to turn with the fairlead's while allowing them to independently tilt and shift slightly.

Although the mooring system 110 of FIG. 6 avoids the need for mounting two bearings precisely concentric and avoids appreciable tilt of the turret, it has the disadvantage that the vertical bearing 134 lies underwater, where maintenance and repair is very difficult, especially for a ball or roller bearing which has large and heavy raceways. As a result, the system 110 of FIG. 6 is not preferred.

Figure 9:
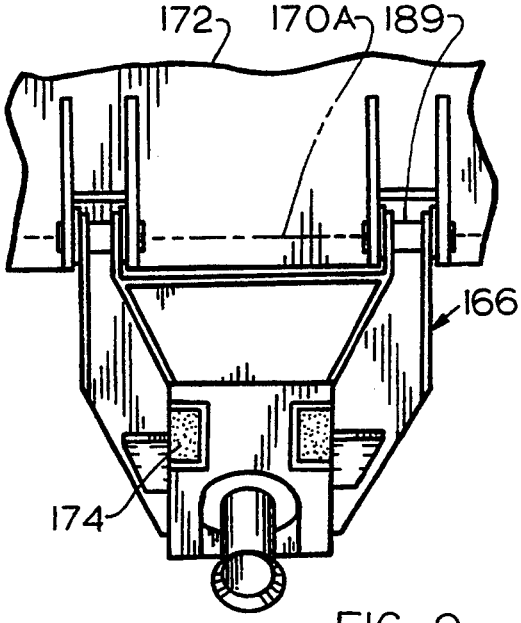
FIG. 9 is a view taken on the line 9—9 of FIG. 8.

FIGS. 7–9 illustrate a preferred mooring system 150 wherein the mooring structure 152 comprises mooring lines such as 162, 164, and the connecting apparatus 154 comprises arms 166 connected to the mooring lines, with each arm pivotally mounted about a corresponding arm axis 170 on the turret 172. The particular system shown has four arms (for four mooring lines), with three of them shown at 166A, 166B, and 166C. Each arm has an upper portion that is pivotally mounted on the turret about a corresponding substantially horizontal arm axis 170 such as 170A, 170B, and 170C. Each arm axis extends substantially in a circumferential direction, that is, perpendicular to a line (e.g. R in FIG. 10) that extends radially from the turret axis 180. Each arm has bearing pads 174 that press radially outwardly (with respect to turret axis 180) against an annular inner surface 181 of a vessel lower bearing device 182 which is in the form of a bearing ring. The turret is rotatably mounted to the vessel hull 183 (FIG. 7) by a turret bearing 185 that lies above the sea surface 15.

As shown in FIGS. 8 and 9, mooring line 162 is attached to a mount 184 which is pivotally mounted about a horizontal mount axis 186 on the arm 166A. Alternatively, the mooring line can be directly fixed to the arm. One or more mooring lines can be coupled to each arm. The mooring lines generally extend at an angle B to the vertical of about 35° in the quiescent position of the vessel, with the angle increasing as forces (wind, waves, and currents) are applied to the vessel. Even the relatively small horizontal component of the mooring load in the quiescent position of the vessel results in the arm 166A lying in a position where its bearing pad 174 constantly engages the lower bearing device 182.

The fact that the arm upper end portions 188 are pivotally mounted on the turret 172, as through arm shafts 189 and a mount bracket 190, results in transmittal of the vertical force component V from the mooring lines such as 162 through the arm to the turret. The arm transmits sideward forces that rotate the turret relative to the vessel hull. The bearing pads 174 are mounted on lower portions 191 of the arms that serve as connecting portions, and the mooring line attachment locations at 186 preferably lie no higher than the pads 174. The main wearing part is likely to be the bearing pads 174, and these are relatively small items that can be readily replaced. The surface 181 of the vessel lower bearing ring is of a hard material that wears very slowly against the softer material of the bearing pads. The fact that the arm can pivot about a horizontal arm axis 170A until the arm abuts the vessel bearing device 182, assures that very little horizontal force will be transmitted to the turret, especially because pivoting about the arm pivot joint 192 occurs with very low frictional torque.

In one system that applicant has designed, the vessel has a dead weight (when full with oil) of 200,000 tons, lies in a sea of 500 feet (150 meters) depth, and when loaded the bottom of the hull lies twenty meters below the sea surface and the deck lies five meters above the sea surface. The vertical load comprises a turret weight of 200 metric tons (440,000 pounds) and chain mooring lines of about 500 metric tons (which varies as the vessel drifts and chain is picked up or laid down from the sea surface). The system is designed for a maximum horizontal load of about 1,000 metric tons for the most severe weather to be encountered. In the quiescent condition, the horizontal load on each of four mooring lines is about ten metric tons, which is applied in different horizontal directions to the arms.

Figure 11:
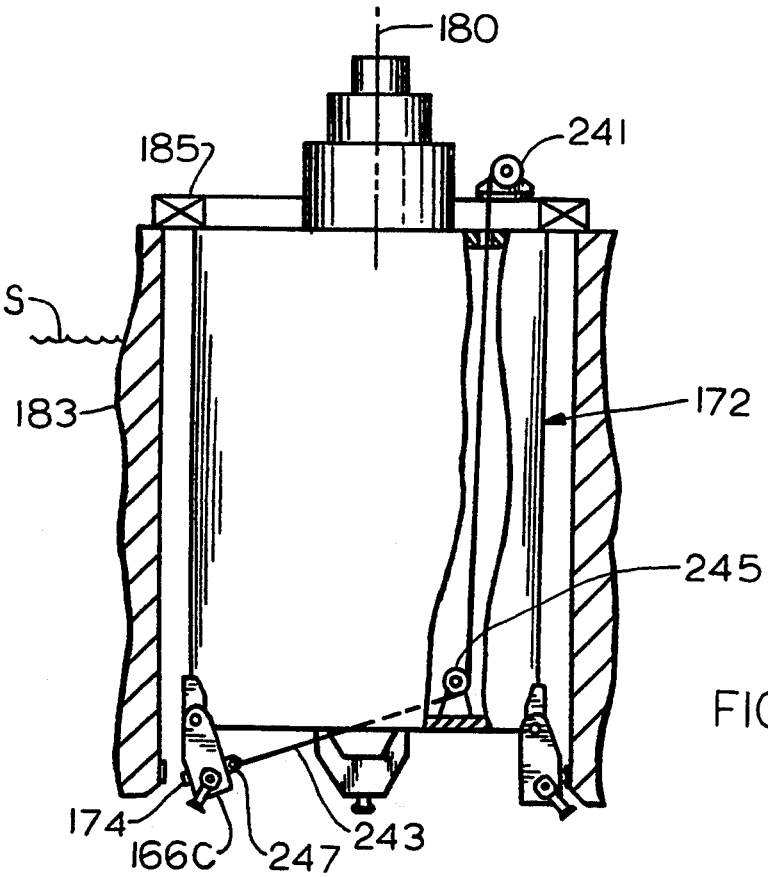
FIG. 11 is a partial sectional view of the mooring system of FIG. 7.

FIG. 11 is a view of the mooring system of FIG. 7, showing a winch device 241 which is used during maintenance of one of the arm 166C, as to replace its bearing pads 174. A cable device (chain, cable, etc.) 243 extends from the winch device around a sheave 245 to a pad eye 247 on the arm. The winch device is operated to tension the cable device and thereby pivot the arm so its bearing pads are readily accessible to divers for replacement. The winch device 241 and sheave 245 are mounted on the turret, so any turning, or other motion of the turret does not affect the arm pivoting apparatus. Replacement is done when the seas are quiescent. Any device that can be operated by a person, can be used to pivot the arm so its bearing pad is moved away from the vessel lower bearing device.

Figure 10:
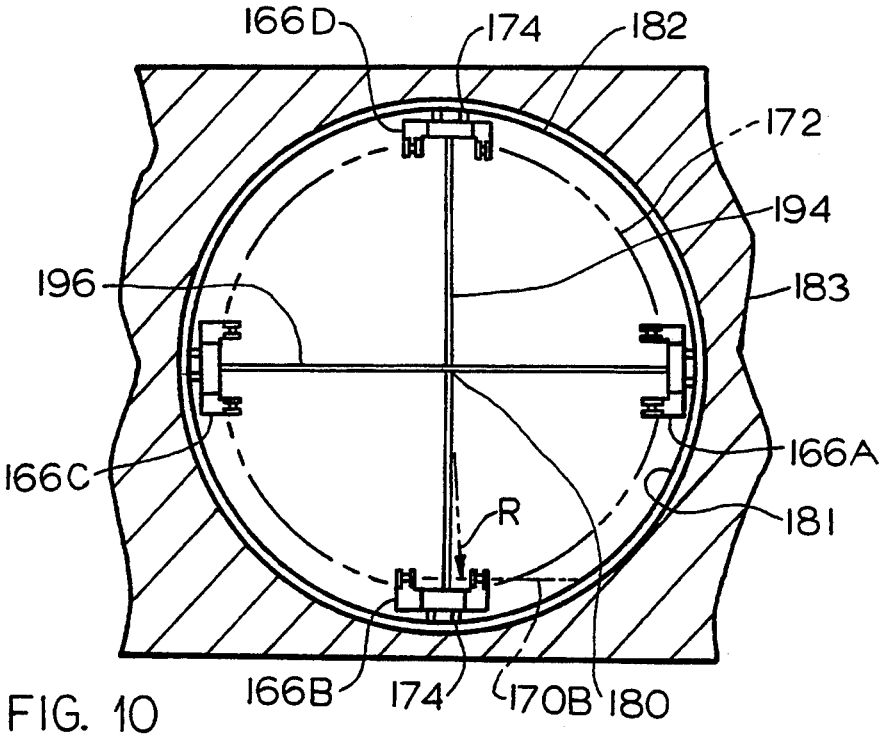
FIG. 10 is a view taken on line 10—10 of FIG. 7, and also showing connecting cables.

FIG. 10 is a view taken on line 10—10 of FIG. 7, but with the turret 172 shown in phantom lines. Also, FIG. 10 shows cables 194, 196 that connect opposite arms, such as 166B and 166D. The cables, which lie below the turret, are tensioned or tightened enough to transmit much of the horizontal load component from one arm to the opposite one. This reduces the force with which the pads 174 press against the vessel bearing device ring 182, especially when the vessel is in its quiescent position, to reduce bearing and pad wear. It is possible to use the winches 240 (FIG. 11) that pivot the arms for pad replacement, to similarly reduce pad wear.

Figure 12:
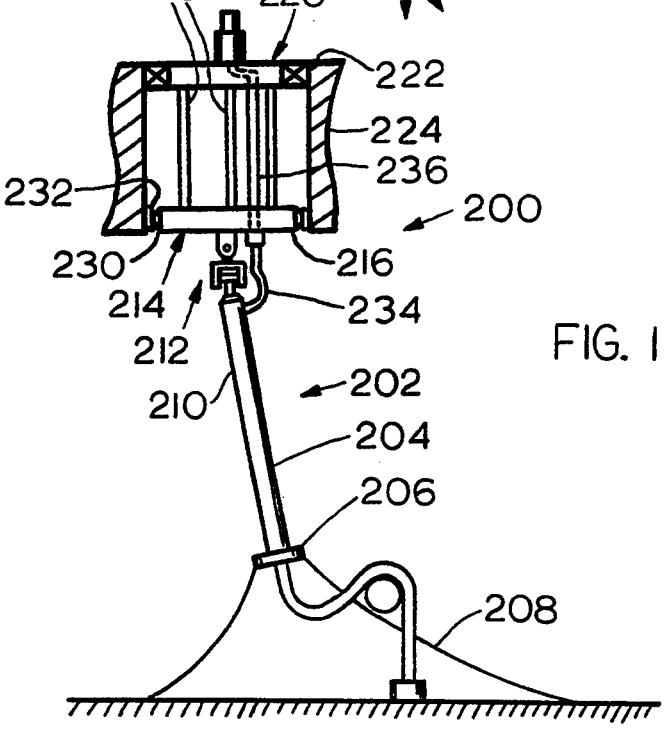
FIG. 12 is a partial sectional side view of another mooring system.

FIG. 12 illustrates another system 200, wherein the mooring structure 202 is in the form of a riser 204 whose lower end is anchored by a chain table 206 and catenany anchor lines 208. The upper end 210 of the riser is coupled through a universal joint 212 (which allows pivoting about two primarily horizontal axes) that hangs from a connecting apparatus 214. The connecting apparatus 214 includes a lower connecting part 216 which is hung by a group of rods 218 from the turret 220. The turret is supported by a turret bearing 222 on the vessel hull 224. The connecting part 216 carries bearing pads 230 that can press against a vessel bearing device 232 which is in the form of a lower bearing ring. A conduit 234 extends through the lower connecting part and includes a substantially rigid pipe 236 that extends to the turret 220. The rods 218 and pipe 236 are thin and long enough that they can bend slightly to permit the lower connecting part 216 to shift horizontally slightly (e.g. a few centimeters for a 10 meter diameter turret), and therefore act like a universal joint that allows only limited pivoting (i.e. up to 3° of pivoting).

Figure 14:
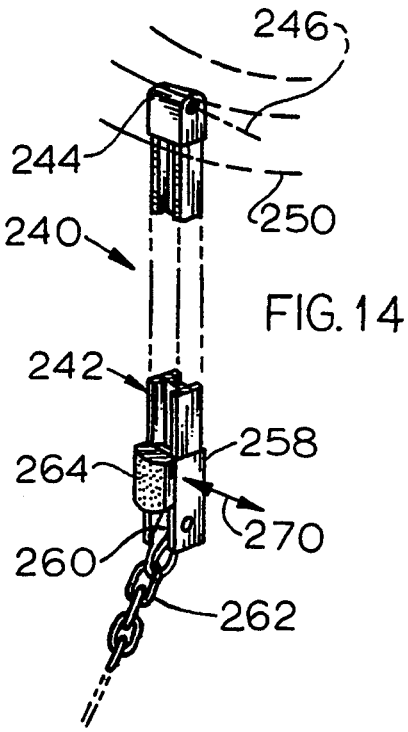
FIG. 14 is a partial isometric view of the mooring system of FIG. 13.
Figure 13:
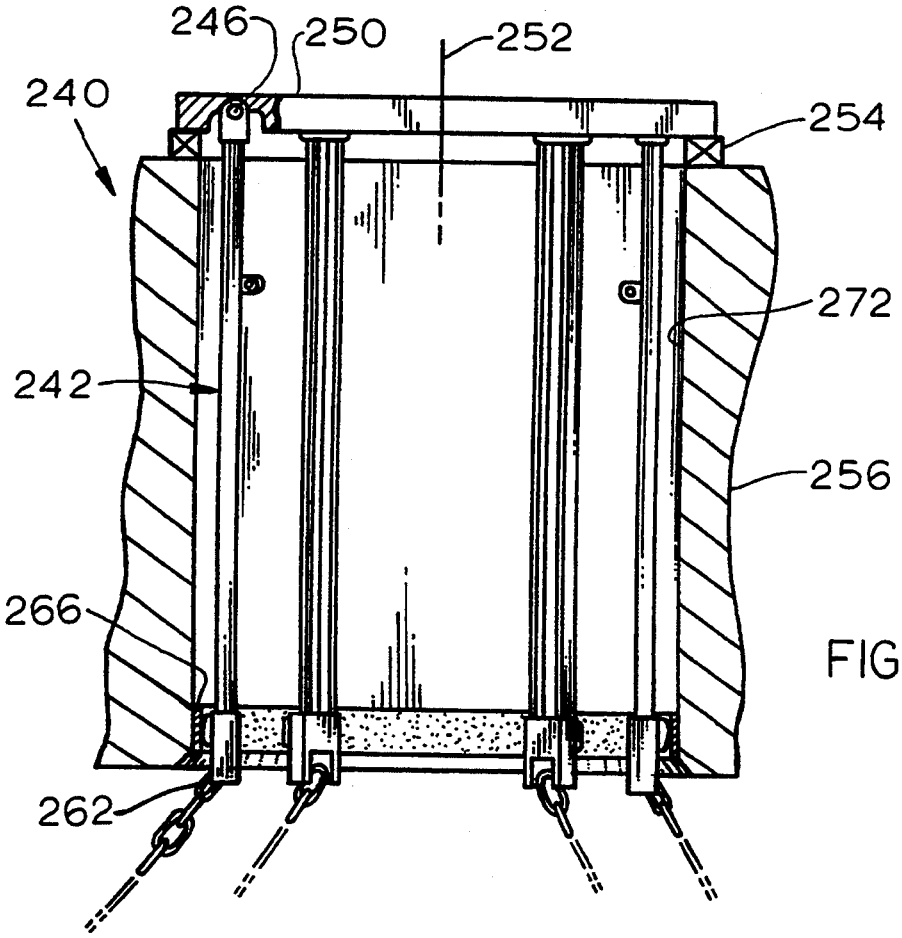
FIG. 13 is a sectional side view of another mooring system.

FIGS. 13 and 14 illustrate another system 240 which includes arms 242 with upper ends 244 pivotally mounted about axes 246 on a turret 250. The turret is rotatably mounted about its axis 252 by a bearing 254 on the vessel hull 256, to lie at least adjacent to the cavity. Each arm has a lower end 258 with a chain coupling 260 coupled to a mooring line 262, and with a bearing pad 264. Each bearing pad bears against a vessel lower bearing ring 266 that is directly mounted on the vessel hull. The arms 242 are shown as including vertically elongated I-beams which are rigid against bending. This results in any force on the arm lower end in a circumferential direction 270 being transmitted to the turret. This system is similar to that of FIG. 10, except that the arms 242 have a vertical length that is more than half the height of the turret cavity 272.

Figure 15:
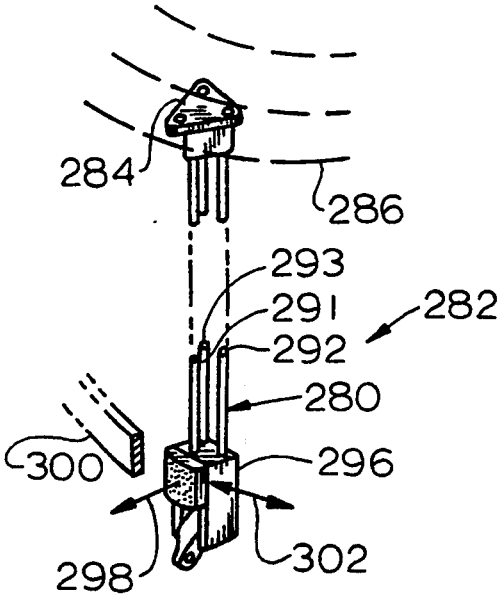
FIG. 15 is a partial isometric view of another mooring system.

FIG. 15 illustrates one arm 280 of a system 282 similar to that of FIGS. 13 and 14, except that the top of the arm is fixed to a mount 284 that is fixed to the turret 286. Also, the arm includes bendable beams 291–293. The beams allow the arm lower end 296 to deflect horizontally a small distance in a radially outward direction 298 to press against the vessel lower bearing ring 300. However, the beams resist more than small deflection of the arm lower end in a circumferential direction 302, relative to the turret, to assure turret turning.

Thus, the invention provides a mooring system for a vessel which includes a turret that rotates about a substantially vertical axis, which avoids the application of large torque to the turret that tends to tilt it, which avoids the need for mounting upper and lower turret bearings precisely concentric on the vessel hull, and which facilitates maintenance of the lower underwater bearing. This is accomplished where a mooring structure is coupled to a connecting apparatus that bears against a vessel lower bearing device to transmit horizontal forces therethrough to the hull, where the vessel lower bearing device is mounted on the hull independently of the turret. The vessel lower bearing device is mounted independently of the turret, in that the bearing device passes horizontal loads to the hull substantially without such loads passing through the turret, and in that the bearing device does not rotatably support the turret and need not contact it. In one embodiment of the invention, the connecting apparatus includes a group of arms pivotally mounted on the lower portion of the turret to transmit vertical loads through the pivot mount, the arms having bearing pads that bear against a ring-shaped vessel lower bearing device mounted on the vessel hull.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A combination of a mooring system and a vessel, wherein said vessel has a hull with walls forming a primarily vertically-extending turret cavity, a turret lying at least adjacent to said cavity and having upper and lower portions, and a turret bearing that couples said turret to said hull to rotatably support said turret in rotation about a turret axis on said hull, wherein said combination includes a mooring structure for mooring said vessel and a fluid conduit that extends from near the sea floor and through said turret, and wherein said turret bearing supports a weight greater than the weight of that portion of the fluid conduit which lies above the bottom of said hull, wherein said mooring structure has a lower portion coupled to the seafloor and an upper portion, characterized by:

a connecting apparatus having a connecting portion coupled to the upper portion of said mooring structure to receive mooring loads transmitted through said mooring structure;

a vessel lower bearing device mounted on said vessel about said axis and lying below said turret upper portion, said connecting apparatus bearing against said vessel lower bearing device to transmit a majority of horizontal components of mooring loads from said mooring structure to said vessel bearing device, said connecting portion of said connecting apparatus being shiftable horizontally substantially independently of said turret.

2. The mooring system described in claim 1 wherein:

said mooring structure comprises a plurality of mooring lines extending downwardly and in different horizontal directions from said vessel;

said connecting apparatus comprises a plurality of arms spaced about said turret and coupled to said mooring lines to receive more than half of all downward and horizontal forces applied by said mooring lines to said vessel, with each arm having an upper portion pivotally supported about a corresponding primarily horizontal arm axis on said turret to transmit downward vertical forces to said turret, and with each arm having a lower portion coupled to said vessel lower bearing device to apply horizontal forces thereto.

3. The mooring system described in claim 2 wherein:

said vessel bearing device comprises a bearing ring that is approximately centered on said turret axis and which has a radially inner annular bearing surface;

said arms each have an arm lower portion and a bearing pad thereon, with each pad positioned to press primarily radially outwardly against said annular bearing surface when the arm pivots in said outward direction.

4. The mooring system described in claim 2 including:

a plurality of cable devices each coupled to one of said arm lower portions, with each cable device being tensionable to urge a corresponding arm lower end away from said vessel lower bearing device.

5. The mooring system described in claim 1 wherein:

said mooring structure comprises a plurality of mooring lines extending downwardly and in different horizontal directions from said vessel, wherein each of said mooring lines has an upper end attached to said turret, and with each mooring line extending primarily downwardly therefrom;

said line connecting apparatus includes a plurality of line guides, each line guide being coupled to a corresponding one of said lines to allow the line to move along its length relative to the line guide, and with each line guide having a bearing coupled to said vessel lower bearing device to transmit horizontal forces to said vessel bearing device, with each line guide being positioned so the corresponding mooring line is bent to extend at an angle of less than 15° from the vertical in extension between a corresponding line guide and said turret.

6. A system which includes a vessel that floats at the surface of a sea where the vessel has a hull comprising cavity walls forming a vertically-extending cavity with upper and lower portions, has a turret lying at least adjacent to said turret cavity, and has a turret bearing lying above the level of said sea surface and supporting said turret upper portion in rotation about a vertical axis with respect to said vessel hull, wherein the system includes a mooring structure that is anchored to the seafloor and which applies mooring forces to said vessel including horizontal force components to limit vessel drift from a quiescent vessel position and a vertical weight force component representing the net weight of said mooring structure that is supported by said vessel, wherein:

said vessel has a vessel lower bearing device mounted on said vessel hull around said axis independently of said turret and lying at a height below the sea surface, and said vessel includes connecting apparatus which is connected to said mooring structure and which is coupled to both said vessel lower bearing device and said turret and which applies most of said horizontal force component to said vessel lower bearing device and which applies most of said vertical weight force component to said turret.

7. The system described in claim 6 wherein:

said mooring structure includes a plurality of mooring lines each extending downwardly and in a different horizontal direction from said vessel to the seafloor;

said connecting apparatus includes a plurality of arms spaced about said turret, each arm being pivotally mounted on said turret about an arm axis that extends substantially horizontally and circumferential to said axis;

each of said mooring lines is connected to a corresponding one of said arms at a location below the arm axis, to apply both horizontal and vertical force components to the arm, and each arm has a part that lies below said arm axis and that can engage said vessel lower bearing device to press radially outwardly thereagainst and thereby transfer horizontal force components to said vessel lower bearing device.

8. A method for mooring a vessel that floats at the surface of a sea, where the vessel has a hull with cavity walls forming a vertically-extending cavity with upper and lower portions, has a turret lying at least adjacent to said turret cavity, and has a turret bearing lying above the level of said sea surface and supporting said turret upper portion in rotation about a vertical turret axis with respect to said vessel hull, wherein the system includes a mooring structure that is anchored to the seafloor and which applies mooring forces to said vessel including horizontal and vertical force components, characterized by:

applying said horizontal force components from said mooring structure primarily to said hull independently of said turret, and applying said vertical force components from said mooring structure primarily to said turret so said vertical force components are supported by said hull through said turret bearing.

9. The method described in claim 8 wherein:

said steps of applying said force components include mounting a ring-shaped vessel bearing device on said hull and substantially concentric with said axis but independent of said turret, mounting a plurality of arms with bearing pads on said turret at locations spaced about said turret so each arm can pivot on said turret about a corresponding horizontal axis to press its bearing pad against said vessel lower bearing device, coupling said mooring structure to said arms, passing the vertical force components through said arms to said turret, and passing the horizontal force components through corresponding one of said arms and through said bearing pads to said vessel bearing device.

10. The method described in claim 9 including:

replacing a bearing pad on an arm, including operating a device to pivot the arm so its bearing pad moves away from said vessel lower bearing device, to provide space for pad replacement.

11. An improvement in a system which includes a vessel that has a hull with walls forming a primarily vertically-extending turret cavil, a turret lying at least adjacent to said cavity and having an upper portion, a turret bearing that couples said turret to said hull to rotatably support said turret in rotation about a turret axis on said hull, and a mooring structure for mooring said vessel, wherein said mooring structure has a lower portion coupled to the seafloor and an upper portion, characterized by:

a connecting apparatus coupled to the upper portion of said mooring structure to receive a majority of both horizontal and vertical load components of mooring loads transmitted through said mooring structure;

a vessel lower bearing device mounted on said vessel about said axis and lying below said turret upper portion, said connecting apparatus bearing against said vessel lower bearing device to transmit a majority of horizontal components of mooring loads from said mooring structure to said vessel bearing device, said connecting apparatus being shiftable horizontally substantially independently of said turret;

said connecting apparatus is coupled to both said turret and said vessel bearing device and transmits to said turret at least 90 percent of said vertical load component but less than 17 percent of said horizontal load component of mooring loads applied to said connecting apparatus by said mooring structure, and transmits to said vessel lower bearing device more than 83 percent of said horizontal load component.

12. An improvement in a system which includes a vessel that has a hull with walls forming a primarily vertically-extending turret cavity, a turret lying at least adjacent to said cavity and having an upper portion, a turret bearing that couples said turret to said hull to rotatably support said turret in rotation about a turret axis on said hull, and a mooring structure for mooring said vessel, wherein said mooring structure has a lower portion coupled to the seafloor and an upper portion, characterized by:

a connecting apparatus coupled to the upper portion of said mooring structure to receive mooring loads transmitted through said mooring structure;

a vessel lower bearing device mounted on said vessel about said axis and lying below said turret upper portion, said connecting apparatus bearing against said vessel lower bearing device to transmit a majority of horizontal components of mooring loads from said mooring structure to said vessel bearing device, said connecting apparatus being shiftable horizontally substantially independently of said turret;

said turret bearing lies above the sea surface and comprises a pair of raceways one joined to said turret and one joined to said hull, and a plurality of rolling elements that each rolls on both of said raceways, to minimize wear of said turret bearing under a high continuous load;

said vessel lower bearing device and said connecting apparatus each lie under the sea surface and each have surfaces of low friction bearing material that directly slide on each other, with one of them comprising a plurality of bearing pads, to provide a low cost and easily repaired bearing.

* * * * *